US005442936A

United States Patent [19]

Berger et al.

[11] Patent Number: 5,442,936

[45] Date of Patent: Aug. 22, 1995

[54] DEVICE FOR CLAMPING AND GUIDING CROCHETING NEEDLES FOR A CROCHETING MACHINE

[75] Inventors: Johann Berger, Alfdorf; Fritz Schülein, Treuchtlingen, both of Germany

[73] Assignee: Berger GmbH, Treuchtlingen, Germany

[21] Appl. No.: 211,193

[22] PCT Filed: Aug. 14, 1992

[86] PCT No.: PCT/EP92/01865

§ 371 Date: Mar. 23, 1994

§ 102(e) Date: Mar. 23, 1994

[87] PCT Pub. No.: WO93/06288

PCT Pub. Date: Apr. 1, 1993

[30] Foreign Application Priority Data

Sep. 24, 1991 [DE] Germany ..... 41 31 809.9

[51] Int. Cl.[6] ..... D04B 27/06; D04B 35/08

[52] U.S. Cl. ..... 66/204; 66/208; 66/123; 66/114

[58] Field of Search ..... 66/203, 204, 205, 206, 66/207, 208, 123, 124, 114

[56] References Cited

U.S. PATENT DOCUMENTS

| | | | |
|---|---|---|---|
| 2,749,729 | 6/1956 | Noe | 66/208 |
| 3,823,581 | 7/1974 | Russo | 66/208 |
| 4,571,961 | 2/1986 | Berger et al. | 66/208 |
| 4,603,561 | 8/1986 | Berger et al. | 66/207 X |
| 4,683,727 | 8/1987 | Zorimi | 66/207 |
| 4,895,006 | 1/1990 | Speich | 66/208 X |

*Primary Examiner*—John J. Calvert

*Attorney, Agent, or Firm*—Kane, Dalsimer, Sullivan, Kurucz, Levy, Eisele & Richard

[57] ABSTRACT

A device for clamping and guiding crocheting needles for a crocheting machine. On the one hand a clamping device for the crocheting needles and on the other hand a knock-over comb are to be created, which permit a very fine spacing. To this end, in the bottom part (27) and in the clamping cover (29) of a clamping device (12), opposite, straight needle beds (73, 74) are arranged closely together. The needle beds (73, 74) have wall surfaces that are inclined in a V-shape. A knock-over comb (20, 80) fixed to the machine has upwardly projecting teeth (86) for the crocheting needles. The spacing of the needle beds and guide elements is at least 12, in particular 14 per centimeter of machine width. The holding bar (23) fixed to the machine and the bottom part (27) of the clamping device (12) have recesses, in particular chambers (77, 76) that face one another, which permit the clamping device to move too close to the teeth (86).

7 Claims, 4 Drawing Sheets

DEVICE FOR CLAMPING AND GUIDING CROCHETING NEEDLES FOR A CROCHETING MACHINE

The invention relates to a device for clamping and guiding crocheting needles, in particular latch type needles, lace needles, and the crocheting needles which the experts call "patent needles". The device must be such that it can be used on crocheting machines in general, in particular on crochet galloon machines. From the EP-PS 0 110 271 (BERGER) a device is known for the clamping of crocheting needles, which, however, does not co-operate with a known knock-over comb, but with a knock-over bar with an upper free, straight edge. On the other hand, a special construction of the bottom part and clamping cover of a clamping device for crocheting needles is known from the EP-PS 0 244 656 (BERGER). There the needle shanks are placed in rectangular grooves of the bottom part and clamping cover, between which rectangular webs remain.

By the present invention, on the one hand a clamping device for the crocheting needles, and on the other hand a knock-over comb are to be created, which permit a very fine spacing, i.e. at least 12, in particular 14, however, also further needles per cm of machine width. It has proved inexpedient to mill in grooves with a rectangular cross-section in this great fineness. A problem in this connection was the obtaining of the necessary precision. On the other hand it proved inexpedient to work with a knock-over bar with a straight upper edge. It was, on the contrary, necessary to guide the needle shanks to prevent that associated eye needles guide the warp threads around the wrong or around two crocheting needle heads each. In addition, measures were required to ensure that also with the high required fineness, the distances between the lengthwise threads of a to be crocheted band or the like are accurately maintained during the mesh formation.

By the invention according to claim 1, this object can be achieved by a clever combination of various measures, only some of which are already known. Surprisingly, bands, in particular elastic bands, can be crocheted with same, the lengthwise threads of which are positioned at identical distances from one another, also in the case of a spacing of in particular 14 per cm of machine width, so that a very uniform looking band can be produced.

Furthermore, the problems of the clamping and guiding of the crocheting needles are solved in a perfect manner. What proved important for the high precision when producing the grooves of the clamping device and the precise clamping-in of the needle shanks, was the V-shaped arrangement of the wall surfaces of the grooves (needle beds).

Another important aspect lies in creating a possibility to guide the clamping device to very close to the teeth of the needle comb, so that the mounting of the crocheting needles inside the clamping device also acts on that part of the crocheting needles which during operation projects beyond the teeth.

Further developments of the invention can be noted from the sub-claims.

The accuracy of the distances between the lengthwise threads of the crocheted bands can be positively influenced by the proper choice of the clamping-in length of the crocheting needles. If during the knock-over operation the heads of the crocheting needles can be retracted so far that they, for example, only still project by 2 mm, no irregularity of the crocheted band can be perceived.

The parts of the knock-over comb provided with teeth can be accommodated in a groove open to the top of a holding bar, as a result of which a high precision of the distances between the teeth can be obtained.

The knock-over comb can, in principle, be constructed in two different ways, i.e. on the one hand with blocks that are arranged closely together, each of which has an upwardly pointing tooth, and on the other hand with plates which at the top have teeth with wall surfaces that are inclined towards one another in the shape of a V.

The grooves produced in this way have in particular triangular shape, but may have rectangular or any inbetween shapes. All that is important is that the needle shanks can be inserted from the top and are held at the sides.

Finally, the shanks of the crocheting needles may have cross-sectional shapes other than the usual ones. The shanks may have a sharp narrow edge at both the top and bottom, or they may have a rounded narrow edge.

Exemplified embodiments with further features of the invention are described in the following with reference to the drawings, wherein.

Figure 1:
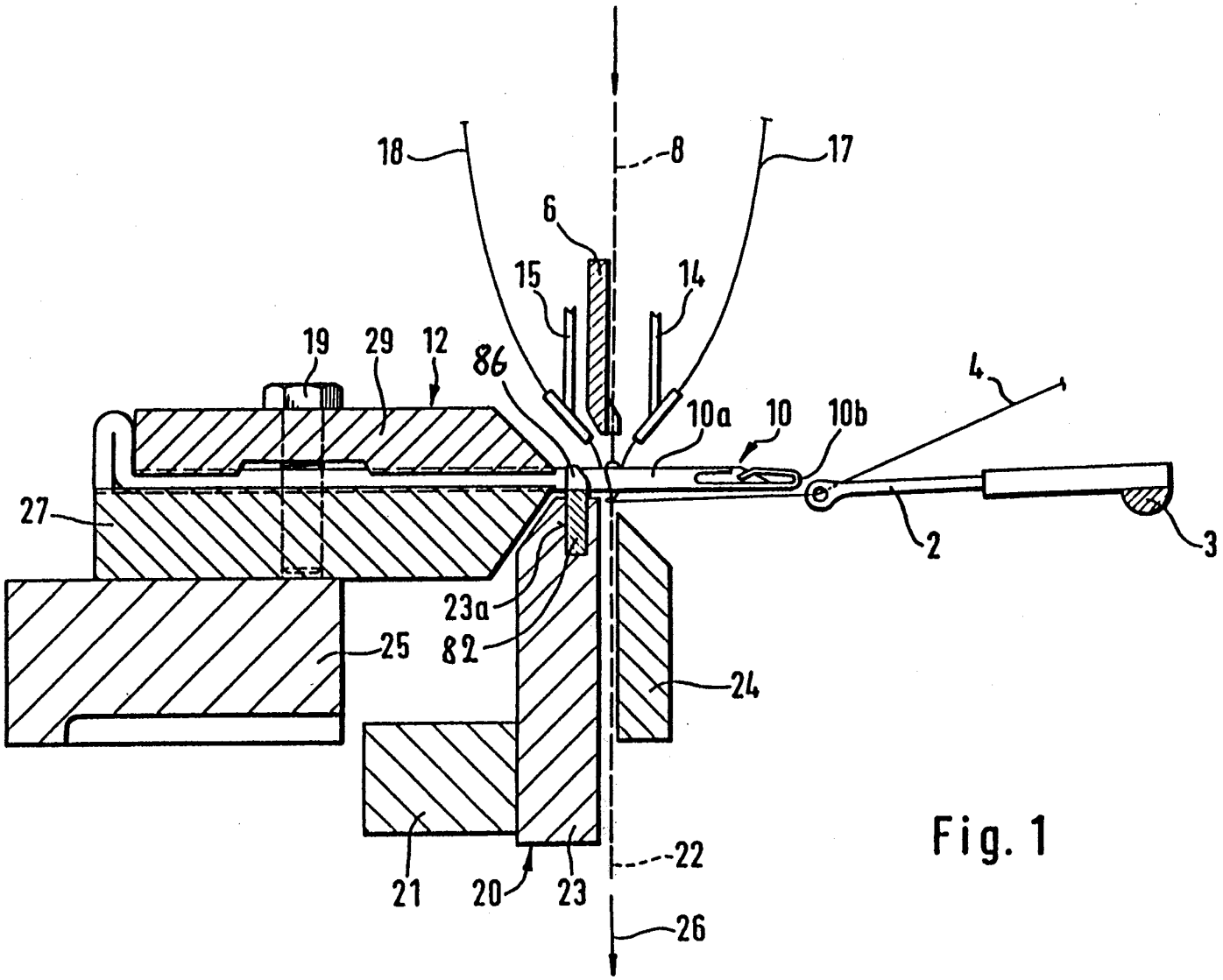
FIGS. 1 and 2 show in a side view a set of crocheting tools of a galloon crocheting machine in two extreme operating positions.
Figure 2:
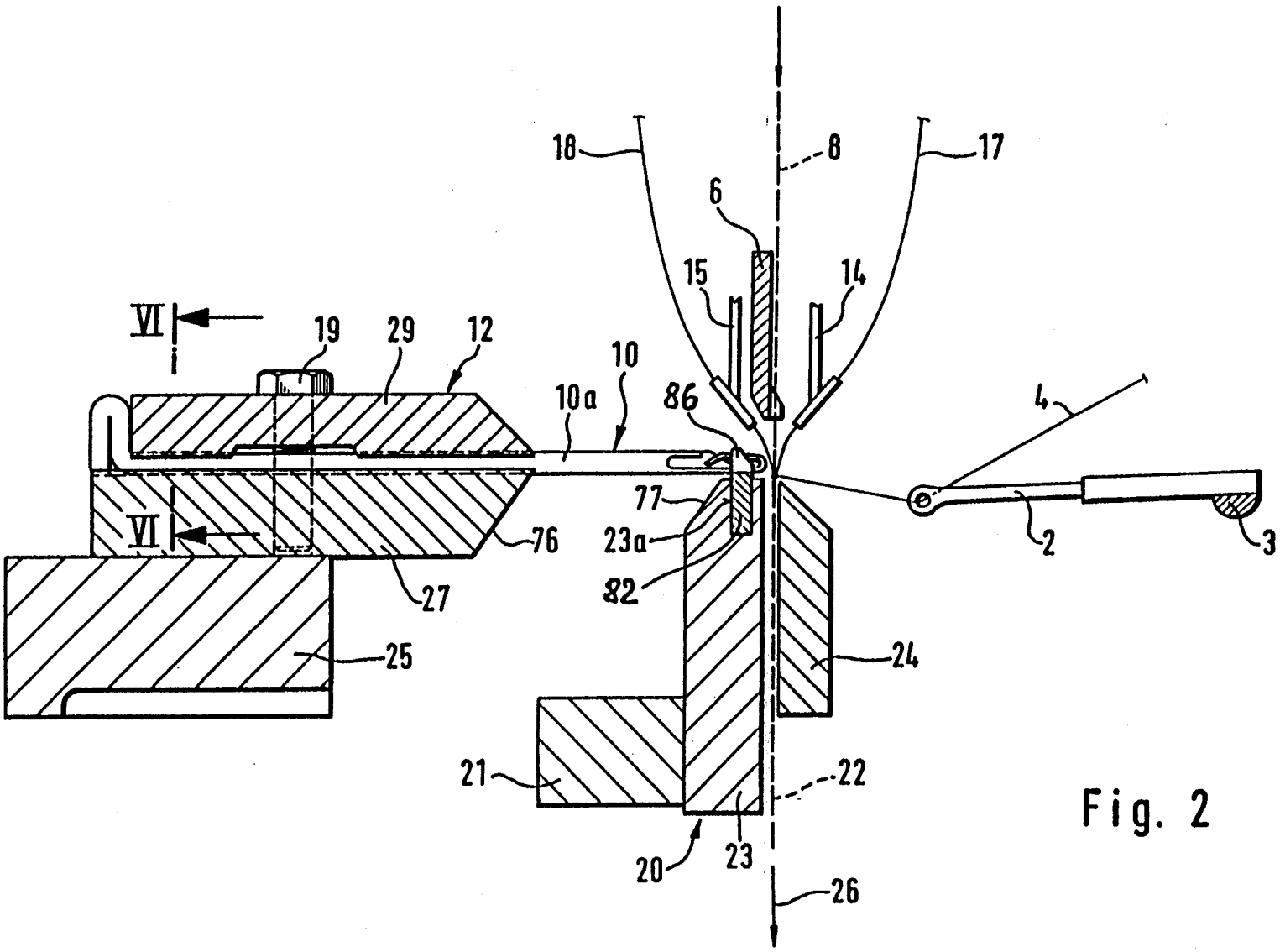

FIGS. 1 and 2 show an arrangement of crocheting tools similar to that of FIG. 1 of the European Patent Specification 110 271 (BERGER). In FIGS. 1 and 2 one notes one of several crocheting needles 10 clamped into a clamping device 12, with a shank 10*a* and a head 10*b*, as well as an eye needle 2 of a group of eye needles arranged next to one another on an eye needle bar 3, which serve to feed in the warp threads 4. A thread comb 6 serves to feed in a group of elastic threads 8. Weft thread guides 14 and 15, which are moved transversely to the drawing plane, serve to feed in weft threads 17 and 18. The elastic band 22 produced by mesh formation is drawn off downwards in the direction of the arrow 26.

This arrangement can be used, among others, to produce elastic bands with crocheted lace.

A clamping device 12, illustrated at the left in FIGS. 1 and 2, for the shanks 10*a* of the crocheting needles is fastened in the known manner to a needle bar 25 and can be moved together with same to the left and right. FIG. 2 shows the left end position, FIG. 1 the right one. The clamping device 12 has a clamping cover 29 and a bottom part 27, which must be pressed together with the aid of screw bolts 19 to clamp in the crocheting needles.

Figure 3:
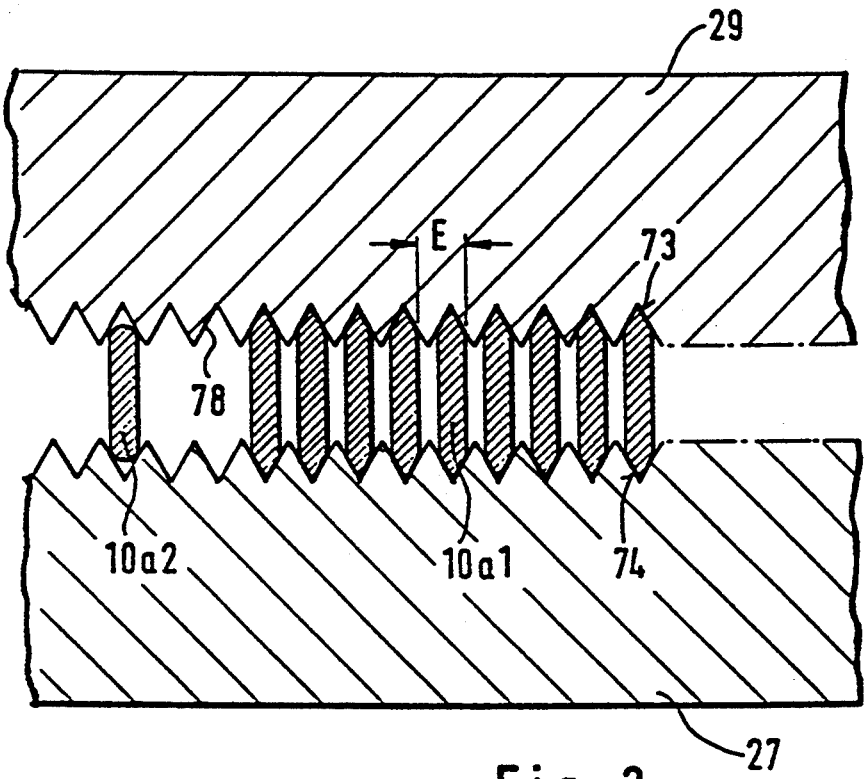
FIG. 3 is a perpendicular partial cross-section in the plane IV—IV of FIG. 2 through the clamping device illustrated there and the clamped-in chrocheting needles.

FIG. 3 is a partial cross-section of the clamping device in a plane VI—VI in FIG. 2. In the clamping cover 29 and bottom part 27, V-shaped grooves 73 and 74, respectively, with slanting wall surfaces 78 are milled in, positioned closely together and lying exactly opposite one another. The grooves extend over the entire width of the clamping cover and bottom part that can be seen in FIG. 2, and all have the same shape and width. In FIG. 3 only some of the grooves are shown. The group of grooves must be imagined continued to the right.

In FIG. 3 on the right a group of shanks 10a1 of crocheting needles is shown, which both at the top and the bottom have a sharp edge 89 (FIG. 8) (preferred shape). On the left in FIG. 3 single shanks 10a1 and 10a2 are shown with a different cross-sectional shape, i.e. a rectangular shape (10a2) or in shape of rounded top and bottom edges (10a1). Always needles of only one cross-sectional shape are used.

In the case of a 14 spacing, every unit E in FIG. 3 consisting of needle and associated inbetween space amounts to 0.71 mm. So that the warp threads 4 and the elastic threads 8 as well as their knots can be passed through between adjoinint crocheting needles, inbetween spaces of 0.33 mm are required. This leaves a width of 0.38 mm for the crocheting needles.

For a 15-spacing and even finer spacings a corresponding arrangement applies.

To obtain coarser spacings than shown in FIG. 3 on the right, the needles can be inserted in only every second, third, fourth, etc. pair of grooves.

The arrangement with triangular grooves on the one hand makes it possible to mill in the grooves very closely together, which is required for the desired fine spacing, and on the other hand to take out individual needles after loosening the screw connection of the clamping device and to replace them by new ones, during which operation the other needles remain unchanged in their former position.

As shown in FIG. 1 and 2, clamping cover 29 and bottom part 27 are pressed together by screw bolts 19. By not illustrated, but known means, it is ensured that the clamping cover 29 cannot move in the horizontal direction (right-left in FIG. 3) relative to the bottom part 27, so that a skew position of the needle shanks is securely avoided.

Figure 4:
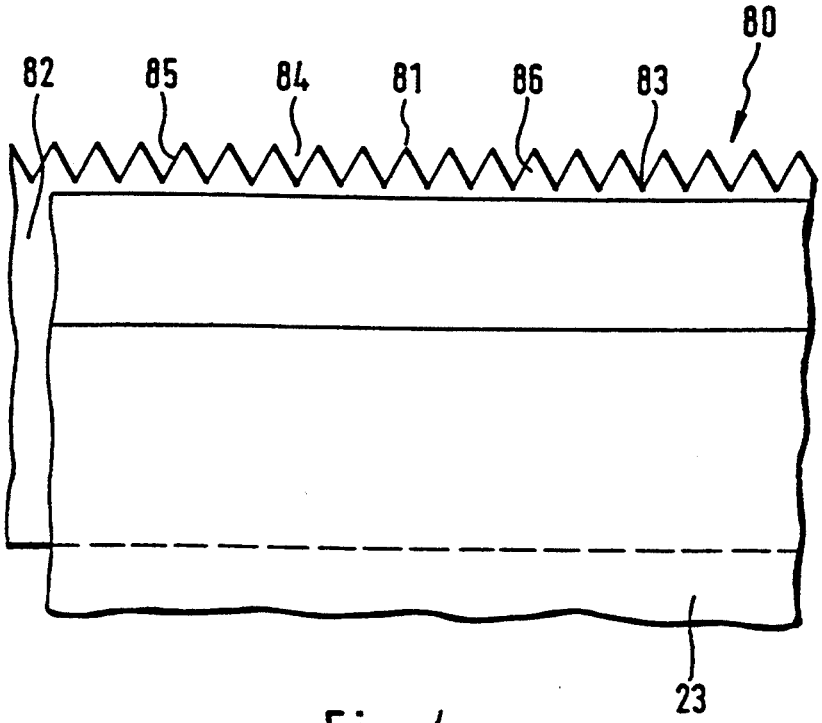
FIG. 4 shows in a side view from the right one of the knock-over combs illustrated in FIG. 2, but without crocheting needles.

FIGS. 1 and 2 show a main cross-bar 21 fixed to the machine, to which a knock-over comb 20 is fastened. The knock-over comb comprises a plate-like holding bar 23, which extends in the direction of the machine width and stands perpendicularly. As illustrated in FIG. 1 and 2, a groove 23a is milled into the holding bar from the top. FIG. 4 shows a cut-out of the knock-over comb 20. Blocks 70 are placed closely together in the groove, each of which blocks 70 has in the centre an upwardly projecting tooth 70a. Open grooves 71 with a rectangular cross-section between every two teeth each serve to guide to guide the shank 10a and head 10b of a crocheting needle 10. The blocks 70 are first of all just placed in the groove closely together, and are only subsequently fastened by glueing. This serves to ensure that the blocks lie closely together and that very accurate distances are maintained between the teeth 70a. This construction is suitable for very fine spacings (up to a 16-spacing), where a high precision of the distances between the grooves 71 is important for the guiding of the needles.

In FIG. 1 and 2, to the right of the knock-over comb 20, a hold-back bar is arranged in such a way that between the two there remains space for drawing off the finished crocheted elastic bands 22.

When using very thin crocheting needles 10 it is important that the clamping device 12 can be guided as closely as possible to the teeth 70a of the knock-over comb 20, so that the part of the crocheting needles projecting from the clamping device becomes as short as possible. To permit this, the holding bar 23 of the one side and the bottom part 27 of the clamping device of the other side have recesses, e.g. chamfers 77 and 76, respectively, that fit together. As shown in FIG. 1, in this way the clamping device can be guided to close to the teeth 70a.

Matching this, the clamping-in length of the crocheting needle shanks is chosen in such a way that the heads 10b of the crocheting needles can be retracted to the left so far that they only still project by about 2 mm from the guide spaces between the teeth 70a (FIG. 2). In this position the formed meshes are knocked over. Due to the fact that the free-standing needle parts are guided very precisely, the use of very thin crocheting needles of 0.38 mm width and less becomes possible. On the other hand, the distances between the needle heads during the knocking over are maintained very accurately. In this way a good looking band is obtained, with which the distances between the elastic threads 8 show no visible differences.

Figure 5:
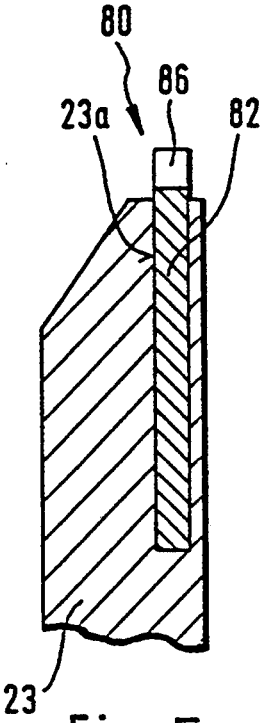
FIG. 5 shows in the same view as FIG. 4 a knock-over comb with triangular teeth.
Figure 6:
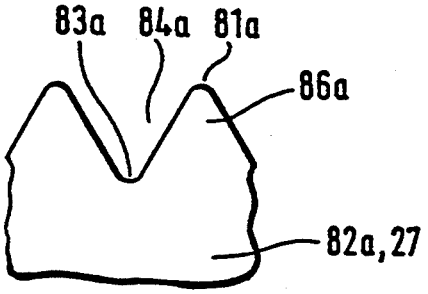
FIG. 6 is a cross-section through the knock-over comb according to FIG. 5.

FIG. 5 and 6 show another embodiment of a knock-over comb 80. Parts that are identical to those in FIG. 1 and 2 have been given the same reference numerals, e.g. the holding bar 23 with a groove 23a produced, for example, by milling. Thin plates 82 are inserted next to one another in this groove and fastened by glueing. Every plate is provided at the top with triangular teeth 86 (with slanting wall surfaces 85) of the same size and shape as the teeth which according to FIG. 3 result between the needle beds 73 and 74. Every plate 82 has a greater horizontal length than shown in FIG. 5, so that a group of needles that co-operate for the crocheting of a band can be guided together by one single plate.

Figure 8:
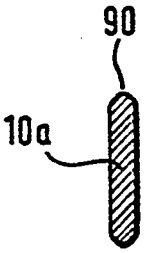

Matching this triangular shape of the teeth and grooves, needles can be used, the shanks 10a1 of which have a sharp edge 89 at the top as well at the bottom, as illustrated in FIG. 8.

The plates 82, the same as the blocks 70 with teeth 70a according to FIG. 4, are made, for example, of brass. Also copper, bronze or a suitable plastic can be used, so that there will be as little friction as possible between the grooves 84 and 71, respectively, and the steel crocheting needles 10.

The distance between the height of the crocheting needles 10 and the grooves 71 and 84, respectively, according to FIG. 4, 5, and 6, is adjusted in such a way that during operation the bottom edges of the needles move freely to and fro inside the grooves. The distances between the teeth 70a (FIG. 4) are greater than the thickness of the crocheting needles. As a result of these two measures the crocheting needles will only now and then touch the walls of the grooves 71, 84, in which case a correction is required. In this way the friction is reduced to a minimum.

The needle beds 73 and 74 (FIG. 3) and the grooves 84 (FIG. 5) need not necessarily have a triangular shape, i.e. they need not have a pointed bottom 83, and the teeth 86 according to FIG. 5 and correspondingly according to FIG. 3 also need not end in sharp edges 81.

Figure 7:
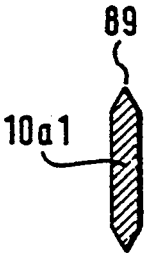
FIGS. 7 and 8 are cross-sections through two different embodiments of crocheting needles.

As shown in FIG. 7, the bottoms of the grooves 84*a* may be rounded surfaces 83*a*, and the teeth 86*a* may end in rounded surfaces 81*a*. This also applies correspondingly to the bottom part 27 and the clamping cover 29 according to FIGS. 1 and 2. When using plates 82 with grooves 84*a* according to FIG. 7, the needle shanks 10*a*3 may have corresponding rounded edges 90 (FIG. 9).

The described constructions can be adapted analogously to other types of crocheting devices.

| LIST OF REFERENCE NUMERALS | |
|---|---|
| 2 | Eye needle |
| 3 | Eye needle bar |
| 4 | Warp thread |
| 6 | Thread comb |
| 8 | Elastic threads |
| 10 | Crocheting needle |
| 10a | Shank |
| 10a1, 10a2 | Shank |
| 10a3 | Shank |
| 10b | Head |
| 12 | Clamping device |
| 14, 15 | Weft thread guide |
| 17, 18 | Weft thread |
| 20 | Knock-over comb |
| 21 | Main cross-bar, fixed to the machine |
| 22 | Elastic bands |
| 23 | Holding bar |
| 23a | Groove |
| 24 | Hold-back bar |
| 25 | Needle bar |
| 26 | Arrow |
| 27 | Bottom part of the clamping device |
| 29 | Clamping cover |
| 70 | Blocks |
| 70a | Tooth |
| 71 | Groove |
| 73, 74 | Needle bed |
| 76, 77 | Chamfer |
| 78 | Wall surface |
| 80 | Knock-over comb |
| 81 | Sharp edge |
| 81a | Rounded surface |
| 82, 82a | Plate |
| 83 | Pointed groove bottom |
| 83a | Rounded surface |
| 84, 84a | Groove |
| 85 | Wall surface |
| 86, 86a | Tooth |
| 89, 90 | Edge |

-continued

| LIST OF REFERENCE NUMERALS | |
|---|---|
| E | Unit |

We claim:

1. Device for clamping and guiding crocheting needles having shanks, for a crocheting machine, a) wherein in a bottom part (27) and in a clamping cover (29) of a clamping device (12) for the shanks (10*a*) of the crocheting needles (10), opposite, straight needle beds (73, 74) which needle beds are arranged closely together, b) and wherein the spacing of the needle beds and guide elements is at least 12 per centimeter of machine width, characterized in that c) the two opposite needle beds (73, 74) for the crocheting needles have wall surfaces (78) that are inclined towards one another in a V-shape, d) a knock-over comb (20, 80) fixed to the machine has upwardly projecting teeth (86) for guiding the needles, e) the teeth (86) have wall surfaces (85) which form grooves in a V-shape, f) a holding bar (23) fixed to the machine and the bottom part (27) of the clamping device (12) have recesses that face one another, permitting the clamping device to move in close relationship to the teeth (86).

2. Device according to claim 1, characterized in that the knock-over comb (23, 80) has a groove (23*a*), open to a top portion thereof, for accommodating plates (82) provided with the teeth (86).

3. Device according to claim 1, characterized in that the wall surfaces (85) of the teeth (86) form sharp edges and groove bottoms (83).

4. Device according to claim 1, characterized in that the parts provided with teeth are made of a material which causes little friction with the steel of the crocheting needles.

5. Device according to claim 1, characterized in that the wall surfaces at the edges are interconnected by means of rounded surfaces (81*a*, 83*a*).

6. Device according to claim 1, characterized in that the shanks (10*a*1) of the crocheting needles have sharp opposite edges (89).

7. Device according to claim 1, characterized in that the shanks (10*a*2) of the crocheting needles have rounded opposite edges (90).

* * * * *